US006845691B2

(12) United States Patent
Hsien

(10) Patent No.: US 6,845,691 B2
(45) Date of Patent: Jan. 25, 2005

(54) RATCHET TOOL WITH MAGNETIC ENGAGING MEMBER

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 6 days.

(21) Appl. No.: 10/357,197

(22) Filed: Feb. 4, 2003

(65) Prior Publication Data

US 2004/0149087 A1 Aug. 5, 2004

(51) Int. Cl.[7] ..... B25B 13/46
(52) U.S. Cl. ..... 81/60; 81/125; 81/63.2
(58) Field of Search ..... 81/59.1, 60–63.2, 81/125

(56) References Cited

U.S. PATENT DOCUMENTS 4,051,935 A * 10/1977 Nakayama ..... 81/59.1
4,328,720 A * 5/1982 Shiel ..... 81/63
5,848,561 A * 12/1998 Hsieh ..... 81/59.1
6,101,902 A * 8/2000 Wei ..... 81/63
6,164,166 A * 12/2000 Whiteford ..... 81/63.1
6,481,315 B1 * 11/2002 Chang et al. ..... 81/60
6,761,092 B2 * 7/2004 Hsien ..... 81/63.2

* cited by examiner

*Primary Examiner*—Hadi Shakeri

(57) ABSTRACT

A ratchet tool includes a head having a hole defined therethrough in which an engaging member is rotatably received. A chamber defined in the inner periphery of the hole and a pawl is movably received in the chamber. A flange extends from an end of the engaging member and is located outside of the hole. A groove is defined in the outer periphery of the engaging member and two magnetic members are engaged with the groove so that the object is attached with the engaging member by the magnetic members. The object can also be further rotated by rotating the flange.

2 Claims, 10 Drawing Sheets

RATCHET TOOL WITH MAGNETIC ENGAGING MEMBER

FIELD OF THE INVENTION

The present invention relates to a ratchet tool wherein the engaging member has magnetic member attached thereto so as to hold object such as a nut engaged with the engaging member.

BACKGROUND OF THE INVENTION

A conventional ratchet tool generally includes a head with a hole and an engaging member is rotatably received in the hole. A ratchet mechanism is received in the head and includes a pawl which has teeth so as to engage with teeth of the engaging member. The engaging member generally includes a hole with a polygonal inner periphery so that a nut or a bolt head can be engaged with the polygonal inner periphery. When the engaging member is co-rotated with the rotation of the handle of the ratchet tool, the nut or the bolt head can be loosened or tightened. In some circumstances, the nut or bolt could be contaminated by toxic material or very hot so that when it is loosened, the user cannot use finger to rotated further and remove it from the hole. Because it is loosened, the ratchet tool does not output an active torque to further rotate the nut or the bolt head, so that the users need a proper mechanism to rotate the object rather than to use their fingers.

The present invention intends to provide a ratchet tool wherein the engaging member has a means for position the object which can be rotated without rotating the ratchet tool.

SUMMARY OF THE INVENTION

In accordance with one aspect of the present invention, there is provided a ratchet tool which includes a head with an engaging member rotatably received in a hole of the head of the tool and a positioning groove is defined in an inner periphery defining the hole. A chamber is defined in the inner periphery of the hole and a pawl is movably received in the chamber.

The engaging member has a flange extending from an end thereof and the flange is located outside of the hole. The engaging member has an engaging hole which has a polygonal inner periphery so that an object engaging with the polygonal engaging hole can be further rotated by rotating the flange.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
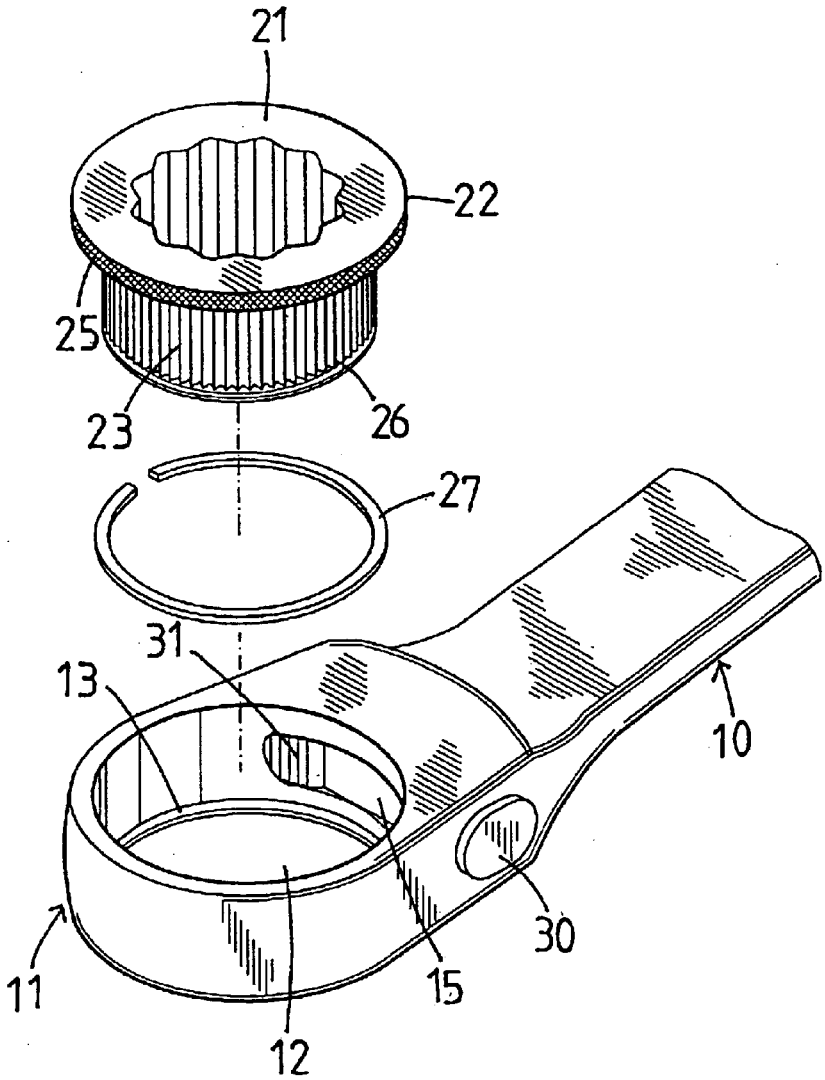
FIG. 1 is an exploded view to show the ratchet tool of the present invention.
Figure 2:
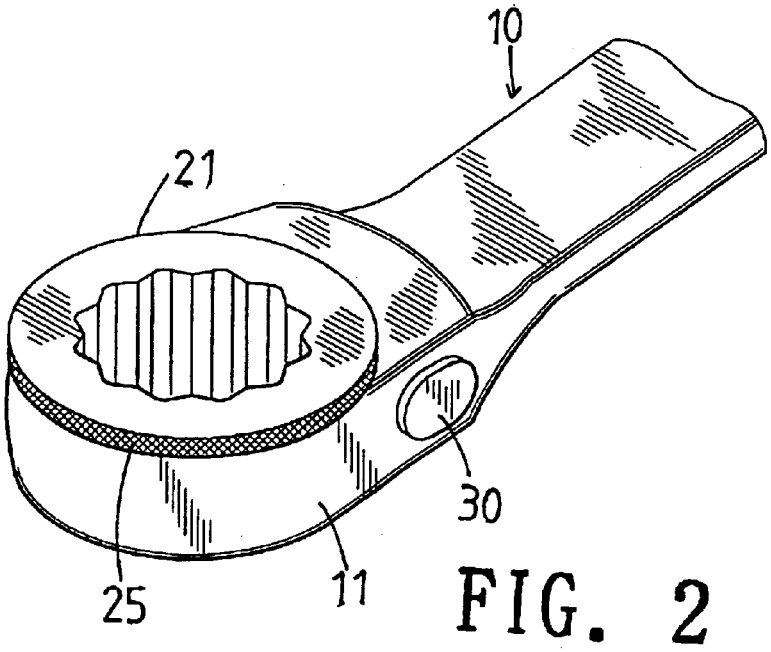
FIG. 2 is a perspective view to show the ratchet tool of the present invention.
Figure 3:
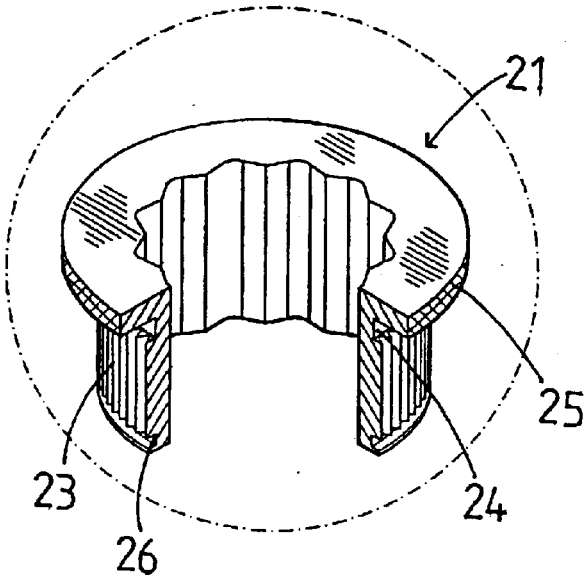
FIG. 3 shows the engaging member of the ratchet tool of the present invention.
Figure 4:
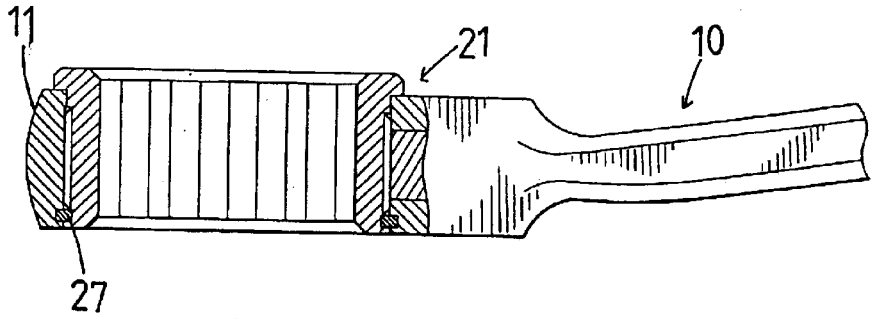
FIG. 4 is a side cross sectional view to show the ratchet tool of the present invention.
Figure 5:
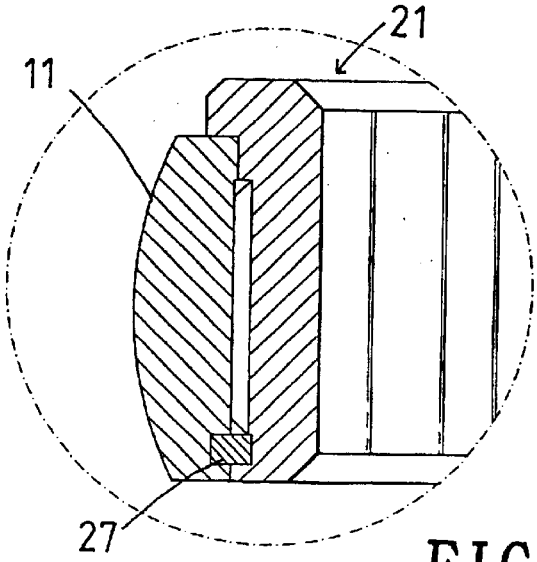
FIG. 5 is enlarged cross sectional view to show the C-shaped clamp positioning the engaging member.

Referring to FIGS. 1 to 5, the ratchet tool 10 of the present invention comprises a head 11 having a hole 12 defined therethrough and a positioning groove 13 is defined in an inner periphery defining the hole 12. A chamber 15 is defined in the inner periphery of the hole 12 and a pawl 30 is movably received in the chamber 15.

Figure 14:
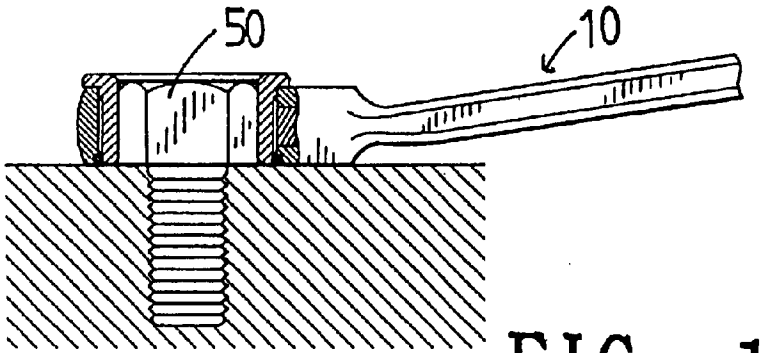
FIG. 14 shows the ratchet tool and a bolt head is engaged with the engaging member.
Figure 17:
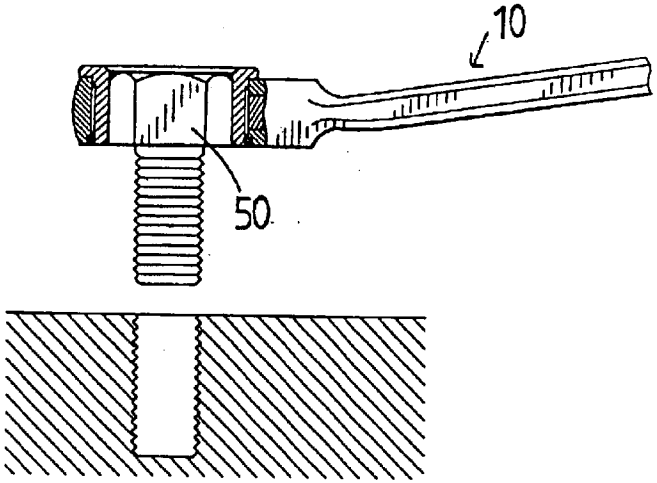
FIG. 17 shows the bolt is removed from the hole where the bolt was threadedly engaged.
Figure 16:
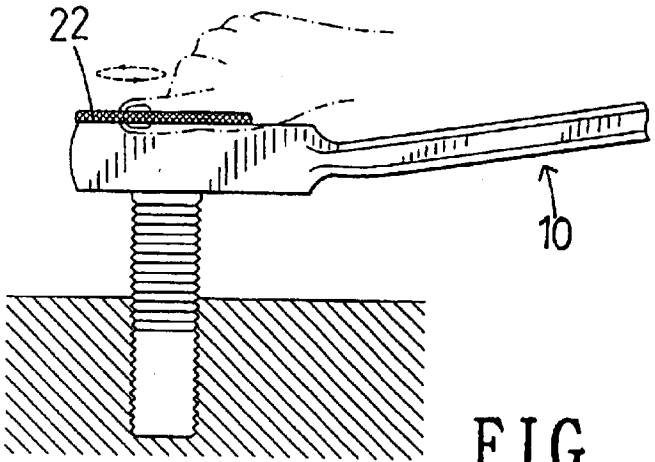
FIG. 16 shows the bolt is further rotated by rotating the flange on the engaging member.

An engaging member 21 has teeth 23 defined in an outer periphery of the engaging member 21 and a flange 22 extends from an end of the engaging member 21. An outer diameter of the flange is larger than an outer diameter of the engaging member. The teeth 23 are engaged with teeth 31 defined in two positions of the pawl 30. The engaging member 21 is rotatably received in the hole 12 and the flange 22 located outside of the hole 12. A knurled surface 25 is defined in an outer periphery of the flange 22 so that the user can conveniently rotate the flange 22 by the friction provided by the knurled surface 25. The engaging member 21 has an engaging hole which has a polygonal inner periphery so as to clamp an object such as a bolt head 50 as shown in FIG. 14.

A first groove 26 is defined in the outer periphery of the engaging member 21 and a C-shaped clamp 27 is engaged with the first groove 26 and the positioning groove 13 to position the engaging member 21.

Referring to FIGS. 14 to 17, when loosening a bolt, the bolt head 50 is clamped by the engaging hole of the engaging member 21 and the ratchet tool 10 is rotated to loosen the bolt. After the bolt is loosened, the user may rotate the flange 22 while the ratchet tool 20 is remained still so that the bolt is co-rotated the rotation of the engaging member 21. The user's hand needs not to touch the bolt.

Figure 6:
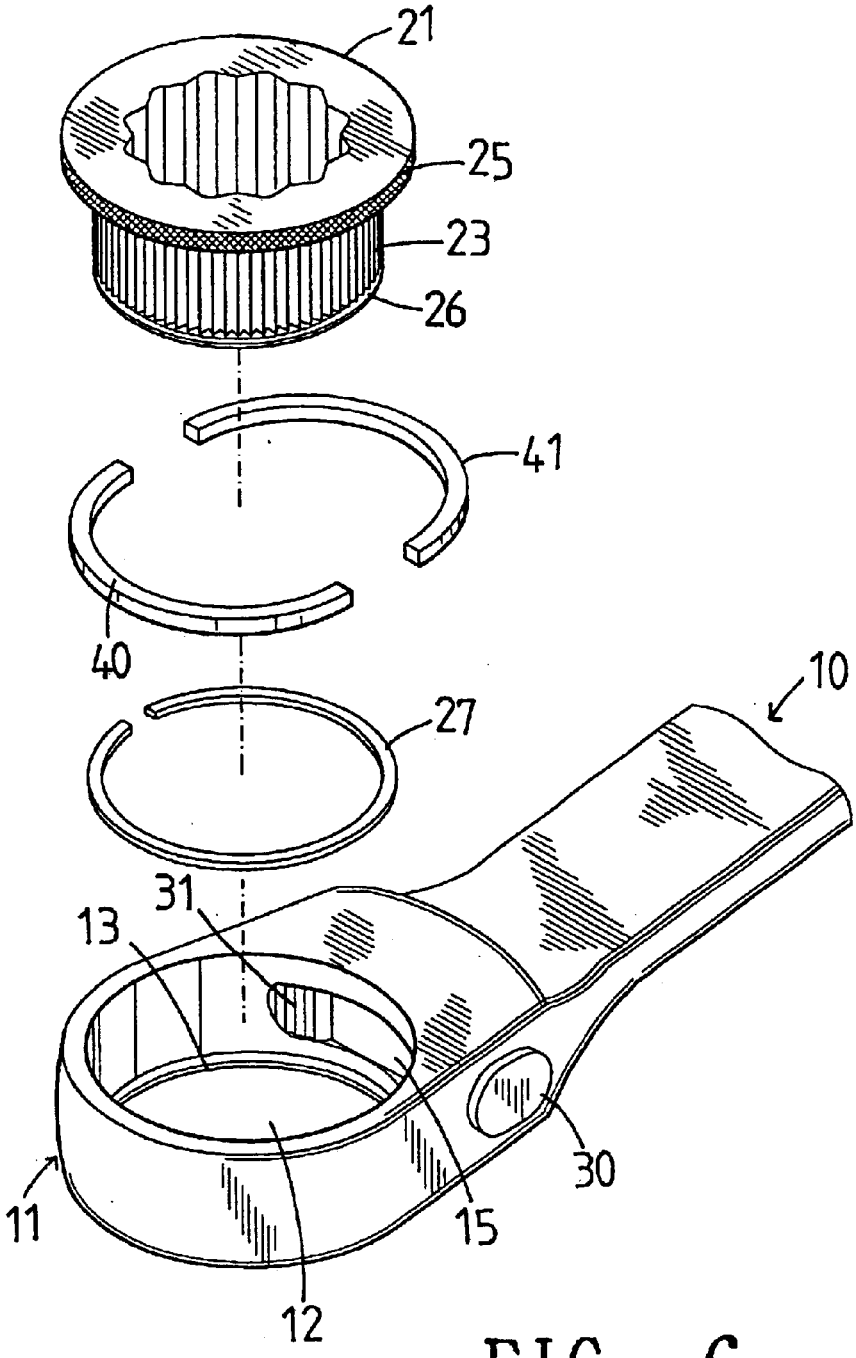
FIG. 6 is an exploded view to show the engaging member has two magnetic member attached thereto.
Figure 7:
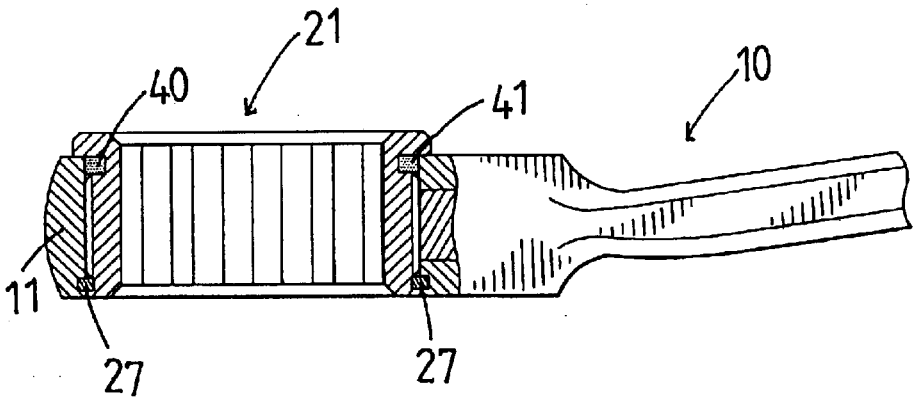
FIG. 7 is a side cross sectional view to show the ratchet tool of the present invention as shown in FIG. 6.
Figure 8:
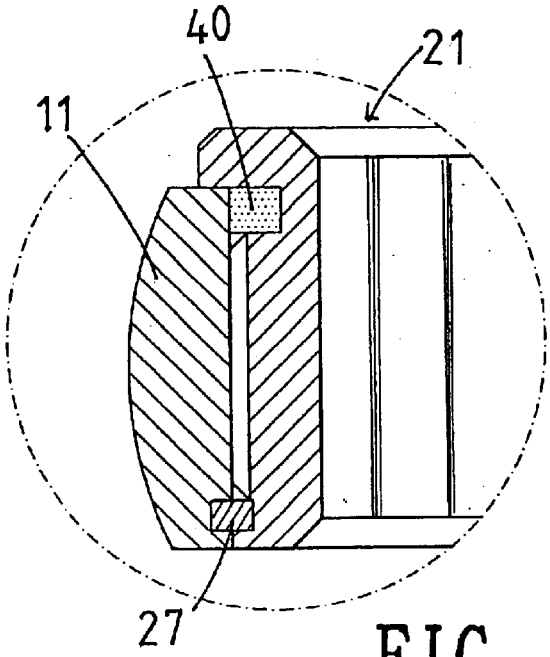
FIG. 8 is enlarged cross sectional view to show the C-shaped clamp positioning the engaging member and the position of the magnetic members.
Figure 9:
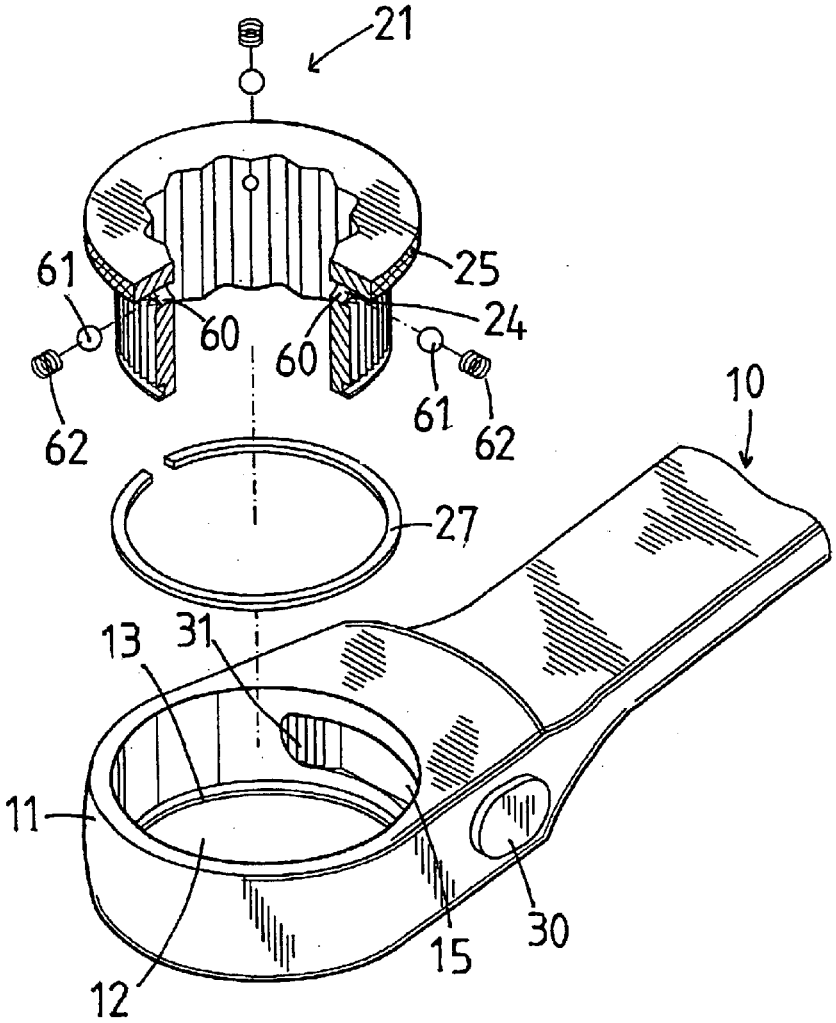
FIG. 9 shows another embodiment of the ratchet tool of the present invention.
Figure 10:
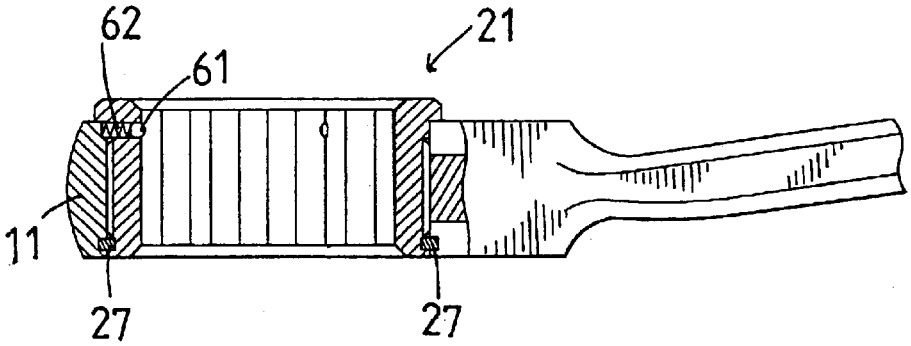
FIG. 10 is a side cross sectional view to show the ratchet tool of the present invention as shown in FIG. 9.
Figure 11:
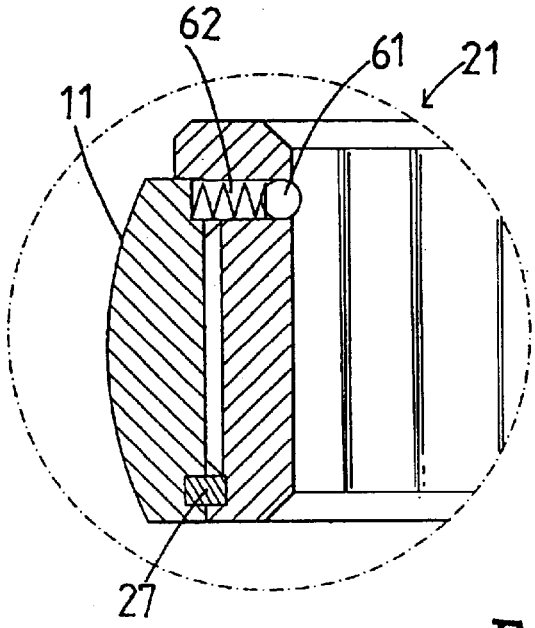
FIG. 11 is enlarged cross sectional view to show the C-shaped clamp positioning the engaging member and the position of the beads and springs.
Figure 12:
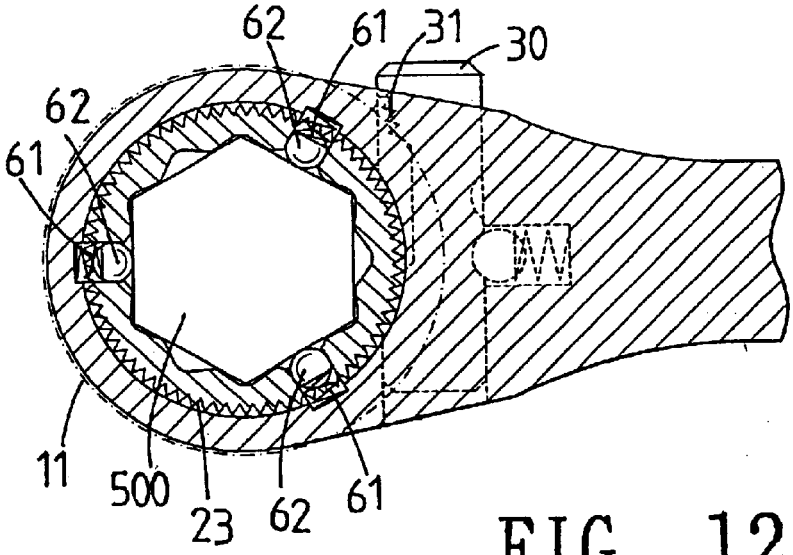
FIG. 12 shows a nut is engaged with the engaging member and positioned by the beads.
Figure 13:
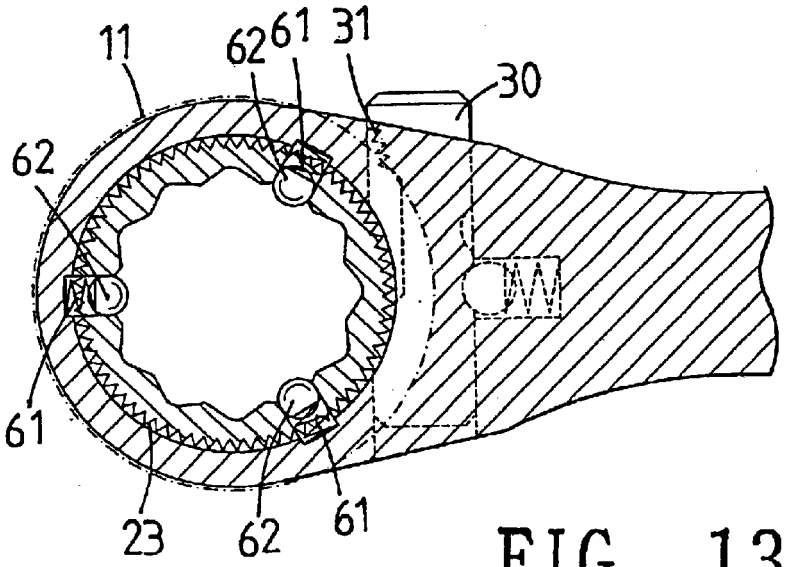
FIG. 13 shows the beads protrude into the engaging hole of the engaging member.
Figure 15:
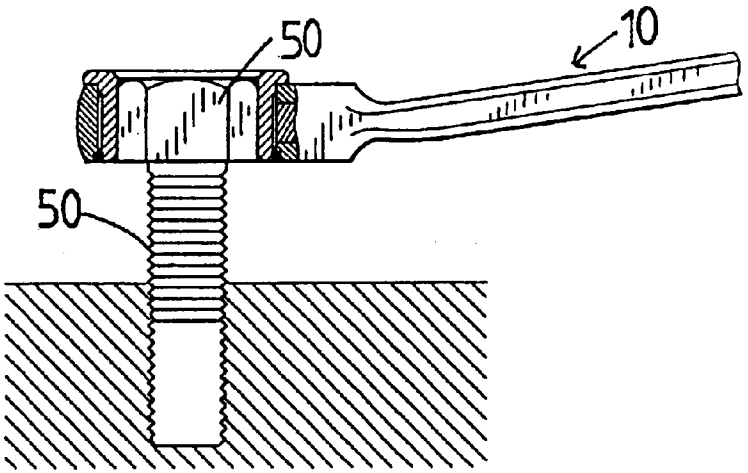
FIG. 15 shows the bolt is unscrewed by rotating the ratchet tool.

As shown in FIGS. 6 to 8, a second groove 24 is defined in the outer periphery of the engaging member 21 and two magnetic members 40, 41 are engaged with the second groove 24. By the magnetic members 40, 41 attract the object that is engaged with the engaging hole of the engaging member 21.

FIGS. 9 to 13 show another embodiment of the present invention wherein a plurality of passages 60 are defined through a wall of the engaging member 21. Each passage 60 has a bead 61 and a spring 62 received therein, and the beads 61 protrude in the engaging hole. The beads 61 biased by the springs 62 hold the object 500 in the engaging hole of the engaging member 21 so that the user's hand needs not to touch the object 500.

While we have shown and described the embodiment in accordance with the present invention, it should be clear to those skilled in the art that further embodiments may be made without departing from the scope of the present invention.

What is claimed is:

1. A ratchet tool comprising:

a head having a hole defined therethrough and a positioning groove defined in an inner periphery defining the hole, a chamber defined in the inner periphery of the hole and a pawl movably received in the chamber, and an engaging member having teeth defined in an outer periphery of the engaging member and a first groove defined in the outer periphery of the engaging member, a C-shaped clamp engaged with the first groove and the positioning groove to position the engaging member, a flange extending radially from an end of the engaging member, the engaging member rotatably received in the hole and the flange located outside of the hole, an outer diameter of the flange being larger than an outer diameter of the engaging member, the engaging member having an engaging hole which has a polygonal inner periphery, a second groove defined in the outer periphery of the engaging member and two magnetic members engaged with the second grooves.

2. The ratchet tool as claimed in claim 1 further comprising a plurality of passages defined through a wall of the engaging member and each passage having a bead and a spring received therein, the beads protruding in the engaging hole.

* * * * *